United States Patent [19]

Giallourakis

[11] Patent Number: 4,920,586

[45] **Date of Patent: * May 1, 1990**

[54] SEAT HANDLE ATTACHMENT

[76] Inventor: Anthony M. Giallourakis, P.O. Box Drawer 1307, Tarpon Springs, Fla. 33589

[ * ] Notice: The portion of the term of this patent subsequent to May 10, 2005 has been disclaimed.

[21] Appl. No.: 283,467

[22] Filed: Dec. 12, 1988

[51] Int. Cl.[5] ..... A47K 17/00

[52] U.S. Cl. ..... 4/251; 4/661

[58] Field of Search ..... 4/251; 16/114 R, 124

[56] References Cited

U.S. PATENT DOCUMENTS

| | | | |
|---|---|---|---|
| 985,535 | 2/1911 | Moriarty | 4/251 X |
| 1,999,555 | 4/1935 | Adams . | |
| 2,758,315 | 8/1956 | Hylton . | |
| 3,191,193 | 6/1965 | Bogenberger . | |
| 3,279,331 | 10/1966 | Platt . | |
| 3,717,884 | 2/1973 | Mantooth . | |
| 3,783,455 | 1/1974 | Vanderbrook . | |
| 3,935,601 | 2/1976 | Hermann . | |
| 4,512,046 | 4/1985 | Riggle . | |
| 4,574,401 | 3/1986 | Nakajima . | |
| 4,576,311 | 3/1986 | Horton et al. | 206/447 |
| 4,606,956 | 8/1986 | Charbonneau et al. | 428/905 |
| 4,742,582 | 5/1988 | Giallourakis | 4/251 |

FOREIGN PATENT DOCUMENTS

| | | | |
|---|---|---|---|
| 180359 | 10/1935 | Switzerland | 4/251 |

*Primary Examiner*—Henry J. Recla
*Assistant Examiner*—R. M. Fetsuga
*Attorney, Agent, or Firm*—James C. Wray

[57] ABSTRACT

A sanitary seat handle has a planar portion for attachment to the underside of a toilet bowl seat. Another planar portion extends radially outward from the rim for maneuvering the seat up or down. The planar extension is a ringlike protrusion which provides an easy grasping or connecting means and low surface area for germ proliferation.

8 Claims, 1 Drawing Sheet

SEAT HANDLE ATTACHMENT

BACKGROUND OF THE INVENTION

The present invention is an improvement over my previous invention which is embodied in U.S. Pat. No. 4,742,582 entitled Seat Handle Attachment.

The focus of my prior patent was to provide a sanitary means for maneuvering a toilet seat from a "down" to an "up" position and vice versa. To facilitate the maneuvering of the toilet seat, an apparatus was devised that would attach to the underside of the toilet seat and extend from the side portion of the underside of the toilet seat away from the toilet bowl. This was done in order to provide a handle means with which one could grasp with the hand or push with the foot. An up or down movement of the handle would result in a subsequent parallel movement of the toilet bowl seat. Thus, one would not have to come in bodily contact with the toilet bowl seat, which commonly is a breeding ground for germs. As well as providing a more sanitary method of maneuvering a toilet seat, an added advantage was that the handle extending out from the side of the toilet seat was more readily and thoroughly cleanable than the toilet seat as a whole. However, such an appendage increases the area on which germs may grow in the unsanitary conditions of rest rooms.

The present invention addresses this problem and is an improvement over my previous patent on seat handle attachments.

SUMMARY OF THE INVENTION

The present invention solves the problem of the possibility of increased germ proliferation that may arise from the increased area provided by the handle extending from the toilet seat attachment.

Previously, the seat handle attachment was a solid, rigid, planar member comprising an attachment portion and a handle portion. The attachment portion was a longish oval member that attached to the underside of the side of a toilet seat using double-sided tape. This tape could be slow-release, volatile, aromatic tape. The attachment of the attachment member efficiently hid the oval attachment portion of the bottom side of the toilet seat. The handle portion was an extension off of the attachment member and extended from a long side of the elongated oval. The handle portion was a circular portion that made a semicircle protruding from the side of the oval attachment portion. The attachment portion was affixed to the underside of the toilet seat in a fashion where the juncture of the handle and the attachment portions met flush with the edge of the side of the toilet seat. Thus, only the handle portion was visible.

It is the improvement of this handle portion which is the object of this invention.

Unlike my previous invention in which the protruding handle was a solid circular portion extending outward from underneath the toilet seat, the present invention is of a circular ringlike structure. In the past, the solid handle structure provided a means by which dirt, liquids, and other medium that promotes germ proliferation might accumulate. However, by lessening the surface area of that handle portion, through substituting a ring having the same or roughly the same diameter as the previous handle portion for the previous handle portion, the area on which germs can grow is sufficiently lessened. Further, the ringlike structure is easier to grasp and more readily held on to than a solid circular structure. The ring allows the tips of the fingers to extend partly or wholly into the ring center; thus preventing or lessening the chances that the handle might slip from the hand during lifting or lowering. Thus, the present invention, and its improvements, provides a more sanitary and more easily used seat handle attachment.

Further objects and features of the present invention will become apparent from the ongoing specifications, drawings and claims.

DESCRIPTION OF THE PREFERRED EMBODIMENTS

Figure 1:
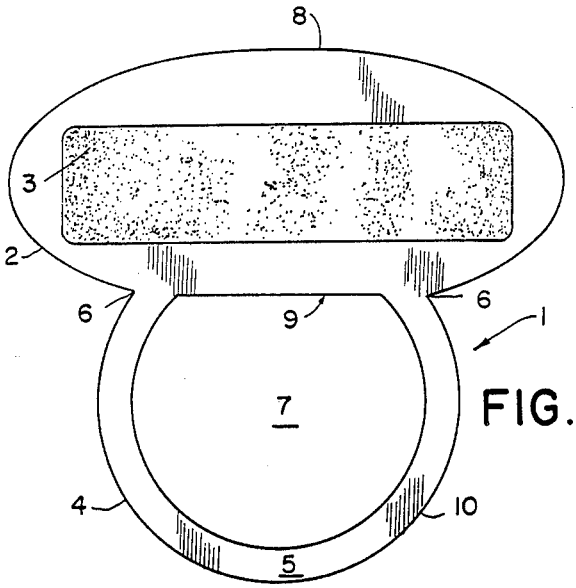
FIG. 1 is an elevated plan view of the invention.

The invention is disclosed in FIGS. 1, 2, 3 and 4 and is denoted generally by the number 1. There is attachment portion 2, handle portion 4, and attachment means 3. Portion 2 is preferably oblongated so as to conform to toilet seat curvature. Preferably the section is 4.75 inches in length. The inner portion of the circular handle portion 7 is evacuated, thus causing the handle portion to take the shape of a ring. The radius of this evacuated inner circle is approximately 1.25 inches when the toilet seat is raised. Handle portion 4 is circular in shape and has a radius of 1.5 inches.

Figure 2:
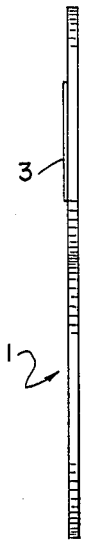
FIG. 2 is a side plan view of the invention.

Looking at FIG. 2, the invention is shown on its side, disclosing it to be a thin, rigid member having a thickness of 3/16 of an inch.

Figure 3:
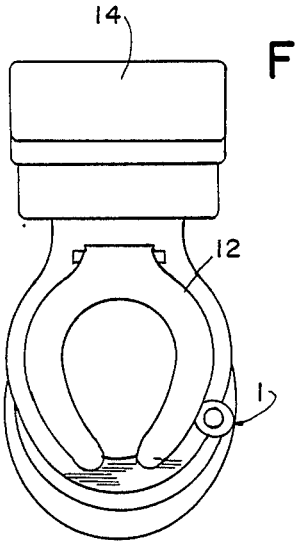
FIG. 3 is an elevated perspective of a toilet in combination with the invention.

FIG. 3 discloses the invention in combination with the toilet seat.

Figure 4:
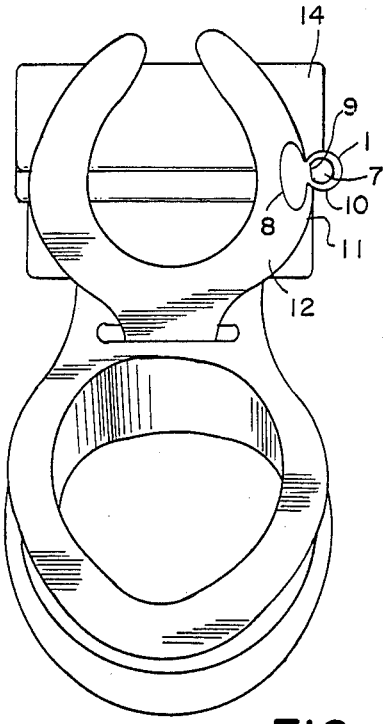
FIG. 4 is an elevated perspective of a toilet in combination with the invention when the toilet seat is raised.

FIG. 4 discloses the invention as it is attached to the underside of the toilet seat.

It is preferred that seat handle attachment 1 be made of a hard rigid plastic such as any thermo-setting resin. The invention may be injection mold formed or cut from a sheet of material by way of a die. The attachment means 3 is preferably a slightly compressible double-sided adhesive tape extending for most of the width of attachment portion 2. When not attached to the underside of a toilet seat, it is preferred the exposed sticky side of tape 3 be covered with a protective removable cover such as wax paper or the like.

Attaching the invention to the underside of a toilet seat is a simple matter. One merely would peel off the protective covering of the exposed sticky surface and attach the portion 2 to the underside of a toilet seat rim such that cusps 6 are aligned with the outermost rim leaving the substantial portion of handle portion 4, 5 exposed for easy access. It is preferred that raised lettering be attached to surface 5 to aid in gripping and to also denote purpose. Evacuated area 7 leaves the handle 1 in the shape of a ring. This ring provides easier gripping and less area for germ proliferation. The ring allows the tips of the fingers to extend partly or wholly into the ring center; thus preventing or lessening the changes that the handle might slip from the hand during lifting or lowering. Furthermore, it is the improvement over the past invention. It should be readily understood that the invention can be constructed out of materials other than plastic without deviating from the spirit of the invention. For instance, the invention can be constructed out of a wood fiber or laminated rigidified cloth, rigidified cardboard, diverse composites, ceramics, etc. The invention is particularly useful in public areas where manipulation of the toilet facilities may be completely performed with the feet obviating the need for any hands to be touching the toilet.

As shown in FIG. 4, the preferred attachment means of the present invention aligns the inner edge 9 of the handle 1 with the outer edge 11 of the toilet seat 12. Thus attached, the outer edge of the handle 10 projects outward from the toilet 14 while the outer edge 8 of the attachment portion is sufficiently under the toilet seat.

As this invention may be embodied in several forms without departing from the spirit or essential characteristics thereof, the present embodiment is therefore illustrative and not restrictive, and since the scope of the invention is defined by the appended claims, all changes that fall within the metes and bounds of the claims or that form their functional as well as conjointly cooperative equivalents are therefore intended to be embraced by those claims.

I claim:

1. A seat handle attachment, comprising:

(a) a rigid planar member, wherein said planar member has an attachment portion and a handle portion, and wherein said attachment portion is wider than said handle portion for sturdy anchoring and said handle portion is longer than the attachment portion to facilitate handling; and (b) attachment means permanently affixed to the attachment portion, wherein said attachment means comprises tape made of a compressible sponge-like material having opposite sticky surfaces for sticking to the attachment portion and an underside section of a toilet seat and for compensating for surface differences between a surface of the rigid planar member and a surface of the underside of the toilet seat, and wherein said attachment portion has an oblongated shape to fit within curved contours of a toilet seat, and further has an inward curvilinear edge and outward curvilinear edges, said outward curvilinear edges being aligned with an outward edge of a toilet seat and further comprises a scent-dispersing means having an impregnated volatile substance which releases slowly, wherein said scent-dispersing means is impregnated in said tape; and wherein further the handle portion is a ringlike protrusion from the attachment means which protrudes from under the toilet seat, provides a finger-hold for fastening point for some leverage device for maneuvering, and a small surface area for proliferation of germs; the handle portion further provides a means for allowing fingers to partially or wholly enter the center of the handle portion, thus preventing slippage of the handle from a hand during lifting or lowering.

2. The device of claim 1 wherein said attachment means is a strip of tape extending along the majority of the length of the attachment portion.

3. The device of claim 2 wherein said tape is a compressible sponge-like material having opposite sticky surfaces for sticking to the attachment portion and an underside section of a toilet seat.

4. The device of claim 1 wherein said attachment portion has an oblongated shape to fit within curved contours of a toilet seat, and further has an inward curvilinear edge and outward curvilinear edges, said outward edges being aligned with an outward edge of a toilet seat.

5. The device of claim 4 wherein said handle portion is substantially circular in shape, whereby said seat handle attachment has an oblongated attachment portion being wider than a circular handle portion, said circular handle having an aperture extending therethrough forming a ringlike protrusion from the attachment portion of the device.

6. The device of claim 5 wherein said handle portion and said attachment portion form cusps where the ringed and oblongate shapes meet, and a solid edge where the inner portion of the ring meets the oblongate shape, said cusps and edge aligning with the edge of the toilet seat for attachment.

7. The device of claim 6 wherein said rigid planar member is a piece of rigid material selected from the group consisting of plastic, wood, cardboard, and ceramic.

8. The device of claim 7 wherein said seat handle attachment is 3/16 of an inch thick.

* * * * *